US008758557B2

(12) United States Patent
Aalto et al.

(10) Patent No.: US 8,758,557 B2
(45) Date of Patent: Jun. 24, 2014

(54) PROCESS FOR PRODUCING FIBROUS MATERIAL FROM WOOD

(75) Inventors: Esa-Matti Aalto, Ravensburg (DE); Hans-Ludwig Schubert, Baienfurt (DE)

(73) Assignee: Voith Patent GmbH, Heidenheim (DE)

( * ) Notice: Subject to any disclaimer, the term of this patent is extended or adjusted under 35 U.S.C. 154(b) by 394 days.

(21) Appl. No.: 12/161,647

(22) PCT Filed: Apr. 4, 2007

(86) PCT No.: PCT/EP2007/003014

§ 371 (c)(1),
(2), (4) Date: Jul. 21, 2008

(87) PCT Pub. No.: WO2007/140839

PCT Pub. Date: Dec. 13, 2007

(65) Prior Publication Data

US 2010/0032111 A1 Feb. 11, 2010

(30) Foreign Application Priority Data

| | | |
|---|---|---|
| Jun. 8, 2006 | (DE) | 10 2006 027 006 |
| Dec. 23, 2006 | (DE) | 10 2006 061 480 |
| Feb. 21, 2007 | (DE) | 10 2007 008 955 |

(51) Int. Cl.
*D21B 1/02* (2006.01)
*D21C 3/06* (2006.01)

(52) U.S. Cl.
CPC . *D21B 1/021* (2013.01); *D21C 3/06* (2013.01)
USPC ..... 162/83

(58) Field of Classification Search
CPC ..... D21C 3/06; D21C 3/08; D21C 3/12; D21C 3/14; D21B 1/021
USPC ..... 162/83
See application file for complete search history.

(56) References Cited

U.S. PATENT DOCUMENTS

| | | | | |
|---|---|---|---|---|
| 4,152,199 | A * | 5/1979 | Hamerstrand et al. | 162/164.6 |
| 8,152,960 | B2 * | 4/2012 | Schubert et al. | 162/141 |
| 2002/0129912 | A1 * | 9/2002 | Reinhard et al. | 162/78 |
| 2006/0266487 | A1 | 11/2006 | Scherb et al. | |

FOREIGN PATENT DOCUMENTS

| | | | |
|---|---|---|---|
| CN | 1 388 287 | A1 | 1/2003 |
| CN | 1 455 046 | A1 | 11/2003 |
| DE | 10 2006 027 006 | A1 | 12/2007 |
| EP | 1 316 639 | A1 | 6/2003 |
| JP | 09 31880 | A | 2/1997 |

OTHER PUBLICATIONS

Ingruber et al. editor, Sulfite Science and Technology, 1985, Joint Textbook Ccommittee of the Paper Industry, third edition, 156-157, 159-212, and 286-288.*

Aikawagroup [downloaded online from www.aikawagroup.com], Freeness conversion, downloaded on Aug. 9, 2010, whole document.*

Ingruber et al. editor, Sulfite Science and Technology, 1985, Joint Textbook Ccommittee of the Paper Industry, third edition, p. 118-120, 130-152 and 254.*

Rydholm, Pulping Processes, 1965, Interscience Publishers, p. 93.*

Feng et al., Comparison of Jack Pine UHY Pulps from bisulphite and nuetral sulphite/SAQ pulps, 1990, TAPPI Pulping Conference, p. 771-780.*

Aft, Freeness Conversion Table (downloaded from www.aikawagroup.com), 2013 (downloaed online Aug. 23, 2013).*

Worster, H.E.: "Semichemical Pulping for Corrugating Grades," 1991, Technical Section Canadian Pulp & Paper Ass'n, XP002464677, Pulp and Paper Manufacture, 3rd Ed, pp. 130-138.

Liebegott T. Joachimides N.: "Choosing the Best Brightening Process," Pulp & Paper, Canada, St. Laurent, CA, vol. 80, #12, Dec. 1979, XP009094432, pp. T391-T395, Fig 1, Tbl. 1.

* cited by examiner

*Primary Examiner* — Anthony Calandra
(74) *Attorney, Agent, or Firm* — Greenblum & Bernstein, P.L.C.

(57) ABSTRACT

A process for producing fibrous material which includes the following: preparing a solution of chemicals that includes less than 25% of sulphite (calculated as $Na_2SO_3$), based on the oven-dry amount of the lignocellulosic raw material; mixing the solution of chemicals with wood in a specified liquor material; heating the solution of chemicals and the wood to a temperature above room temperature; and then either of the following alternatives: (1) removing the free-flowing solution of chemicals and digestion of the wood in the vapor phase; (2) having the wood digested in the liquid phase and separating the free-flowing solution of chemicals and the wood.

51 Claims, No Drawings

PROCESS FOR PRODUCING FIBROUS MATERIAL FROM WOOD

CROSS-REFERENCE TO RELATED APPLICATIONS

This application is a national phase of international application PCT/EP2007/003014, which international application was filed on Apr. 4, 2007.

In addition, this application claims priority under 35 U.S.C. §119 of the following three German patent applications: 10 2006 027 006.1, filed on Jun. 8, 2006; 10 2006 061 480.1, filed on Dec. 23, 2006; and 10 2007 008 955.6, filed on Feb. 21, 2007.

BACKGROUND OF THE INVENTION

1. Field of the Invention

The invention relates to a process for producing fibrous material from lignocellulosic raw materials with little use of chemicals. The invention relates in particular to a process for producing fibrous material having a high lignin content, e.g., of more than 15% for softwoods and more than 12% for hardwoods, based in each case on the oven-dry fibrous material produced, the fibrous material generally having specified strength properties.

2. Background Information

Processes which produce fibrous materials having a relatively high lignin content of more than 15% for softwood and of more than 12% for hardwood are known. They give a yield of 70% or more, based on the starting material used. These processes are based on chemical and/or on mechanical disintegration of the wood.

In the case of mechanical defibration of the wood, the latter is separated into fiber bundles in beating units—generally after presteaming. These fiber bundles are then defibrated into individual fibers by further beating. The yield is very high but so is the quantity of beating energy to be applied. The strength of the wood fibers is very low—even after beating—because the fibers contain a large amount of natural lignin and therefore have little binding potential. They are also strongly degraded by the mechanical defibration, which adversely affects their recyclability.

In the case of chemical digestion of the wood, chemicals act on the wood, generally under high pressure and at elevated temperature. The NSSC process may be mentioned as a typical process for high-yield fibrous materials (Semichemical Pulping for Corrugating Grades, page 130 et seq.; in Pulp and Paper Manufacture, 3rd Edition, Vol. 4, Sulfite Science and Technology—ISBN 0-919893-04-X). In this process, an alkaline component, typically sodium carbonate, is also always used in the digestion solution in addition to sodium sulphite. However, other processes, such as the kraft or the soda process, can also be modified so that high-yield fibrous materials are produced (cf. "Choosing the best brightening process", N. Liebergott and T. Joachimides, Pulp & Paper Canada, Vol. 80, No. 12, December 1979). If the degradation of the originally used wood is to be limited to a maximum of 30%, far less chemicals are required and used than in the production of chemical pulps which are to be completely freed from lignin. For the production of high-yield chemical pulps, the amount of chemicals is metered as a function of the desired yield. In order to achieve a yield of about 70%, based on oven-dry wood use, the prior art recommends using up to 10% of chemicals, based on the starting material. In the case of chemical pulps, the use of chemicals is often 30% or more of chemicals, based on the oven-dry wood.

Chemicals play a role in determining the process costs, i.e., they are used as sparingly as possible. CTMP fibrous materials are usually produced with amounts of 3% to 5% of chemicals. In known, industrially established processes for producing high-yield fibrous materials, e.g., the NSSC process, up to 10% of chemicals, based on the starting material, are used. With the use of chemicals limited in this manner, no recovery is as yet installed for recovering the chemicals. In spite of the relatively small amounts of chemicals, this method of fibrous material production leads to considerable pollution of the environment, in particular of bodies of water, not only because of the introduction of chemicals but especially because of the organic load which is released into the main outfall.

In addition, sharply rising energy prices add to production costs in the case of mechanically produced fibrous materials. In the case of chemically produced high-yield fibrous materials, the production is adversely affected by the costs for the lost chemicals.

High-yield fibrous materials are beaten to high freenesses for the current intended uses. Only then do they reach an acceptable strength level. Here, high freenesses are to be regarded as values of about 300 ml CSF (Canadian Standard Freeness), equivalent to 41°SR (Schopper-Riegler, see below) and 500 ml CSF, equivalent to 26°SR, as described, for example, in "Choosing the best brightening process", N. Liebergott and T. Joachimides, Pulp & Paper Canada, Vol. 80, No. 12, December 1979, for high-yield fibrous material from softwood. A high freeness is achieved by using mechanical energy. The fibers are rubbed against one another or against a grinder or against a grinding medium and thus changed in their surface properties to achieve better binding behavior. The high freeness is therefore not an end in itself. Rather, it arises out of the requirements regarding the strength properties of the fibers.

The high-yield fibrous materials produced by a mechanical and/or chemical method are used in particular where high final whiteness and high whiteness stability are not absolutely essential. They could open up numerous further fields of use if the strength level could be increased.

SUMMARY OF THE INVENTION

The invention provides a process for producing fibrous material, by means of which fibrous materials of high strength can be produced in an economical manner.

More particularly, the invention provides for process for producing fibrous material from lignocellulosic raw material, comprising the following:

- preparing a solution of chemicals comprising less than 25% of sulphite (calculated as $Na_2SO_3$), based in each case on the oven-dry amount of the wood used,
- mixing the solution of chemicals with the wood in a specified liquor ratio, heating the solution of chemicals and the wood to a temperature above room temperature and then either of the following:
- first alternative:
  - removing free-flowing solution of chemicals, and digesting the wood in the vapor phase;
- second alternative:
  - digesting the wood in the presence of the solution of chemicals in the liquid phase, and
  - separating the free-flowing solution of chemicals and the wood.

The process according to the invention is based on the fact that a minimum of chemicals is used for producing high-yield fibrous materials. In spite of the use of few chemicals, the process according to the invention gives fibrous materials in a good yield and with excellent strength properties. Thus, for softwood fibrous materials which are produced according to a particular embodiment of the process according to the invention, breaking lengths of more than 8 km, but also breaking lengths of more than 9 km and more than 10 km, are measured at freenesses of only 12°SR to 15°SR. For hardwood fibrous materials which are produced according to a particular embodiment of the process according to the invention, values of more than 5 km, but also breaking lengths of more than 6 km and more than 7 km, are measured at only 20°SR. Thus, the desired high strength level is achieved.

In the process described in DE 10 2006 027 006, which is regarded here as the closest prior art, it was first thought that the quality of the high-yield fibrous material produced there was attributable to the high level of use of chemicals of more than 10% (calculated as NaOH) for softwood and of more than 7% (calculated as NaOH) for hardwood. However, experiments have shown that a fibrous material having the same quality can be produced if far smaller amounts of sulphite are used and if the use of alkali, e.g., of NaOH or of $Na_2CO_3$, is dispensed with. In the process according to the invention, the sulphite requirement can be reduced by 10% to 50%, and in most cases by 20% to 40%, usually by 25% to 35%, compared with the process according to DE 10 2006 027 006. Considerable progress is thus achieved firstly in the process costs. Secondly, the process according to the invention is far more environmentally friendly because altogether a minimum of chemicals is used in order to produce a particularly high-quality and versatile fibrous material. Moreover, only little and therefore particularly economical and environmentally friendly reprocessing of chemicals is required for closing the cycle of this process.

According to an advantageous embodiment, the process according to the invention is used for producing high-yield fibrous materials. These high strength values have not been known to date for fibrous materials having a lignin content of more than 15% for softwood fibrous materials and of more than 12% for hardwood fibrous materials. The high strength level can, however, also be retained for fibrous materials having an even higher lignin content. The process according to the invention is also suitable for producing softwood fibrous materials having a lignin content of more than 17%, more than 19% in a particular embodiment, and, advantageously, more than 21% in a further embodiment, based on the oven-dry fiber material. Hardwood fibrous materials having a lignin content of more than 14%, more than 16% in a particular embodiment, and more than 18% in a further embodiment, can likewise be produced by the process according to the invention and show a high strength level.

The advantages described above are true without limitation for such high-yield fibrous materials. It is to be regarded as an extraordinary advantage of the process according to the invention that the strength values described are achieved even at extremely low freenesses, as have not been available to date for high-yield fibrous materials in combination with high strength values. Fibrous materials according to the prior art have an unacceptable strength level at freenesses of 12°SR to 15°SR for softwood fibrous materials or of 20°SR for hardwood. At these low freenesses, known fibrous materials have to date given fibers which have not had sufficient binding power and which accordingly have not had sufficient strength properties for commercial use of such fibrous materials.

In contrast, the fibrous materials produced by the process according to the invention have breaking lengths of more than 8 km to 11 km and tear resistances of more than 70 cN to more than 110 cN, based on a sheet weight of 100 g/m$^2$, even at freenesses in the range from 12°SR to 15°SR. These low freenesses are moreover achieved with a low specific demand for beating energy, which is less than 350 kWh/t of fibrous material for softwood fibrous materials; in the case of hardwood fibrous materials, the demand for beating energy may even be less than 250 kWh/t of fibrous material. The discovery that the high strength level is achieved even at low freenesses of 12°SR to 15°SR for softwood and at 20°SR or less for hardwood is a substantial part of the invention.

The composition of the solution of chemicals used for the digestion can be tailored to the wood to be digested and the desired properties of the fibrous material. As a rule, a sulphite component alone is used. Alternatively or in addition, a sulphide component may be added. A digestion with a sulphite component is not disturbed by the presence of sulphide components. Sodium sulphite is generally used industrially, but the use of ammonium or potassium sulphite or of magnesium bisulphite is also possible.

To have recognized the advantages of using a quinone component for the high-yield digestion according to the invention is regarded as an independent inventive performance. Quinone components, in particular anthraquinone, have been used to date in the production of chemical pulps having a minimum lignin content in order to prevent an undesired attack on the carbohydrate towards the end of the digestion. By adding quinone components, it is possible to continue the digestion of wood until almost complete degradation of the lignin. That quinone components significantly increase the rate of the ligninsulphonation in the production of high-yield chemical pulps has to date proved to be an unrecognized, unexpected property of said quinone components. For example, in the production of softwood fibrous materials, the duration of the digestion can be shortened by more than a half, depending on digestion conditions by more than three quarters. This remarkable effect is achieved with minimum use of quinone. Use of, for example, anthraquinone in an amount of between 0.005% and 0.5% is optimum. Use of anthraquinone in an amount of up to 1% also has the desired effect. Use of more than 3% of anthraquinone is generally uneconomical.

A solution of chemicals is prepared from individual chemicals or a plurality of chemicals from among the abovementioned chemicals. In general, an aqueous solution is prepared. As an option, the use or the addition of organic solvents can also be provided. Alcohol, in particular methanol and ethanol, gives, as a mixture with water, particularly effective solutions of chemicals for producing high-quality high-yield fibrous materials. The mixing ratio of water and alcohol can be optimized for the respective raw material in a few experiments.

The process according to the invention can be carried out in a wide pH range. Depending on the amount of the sulphite used or on the composition of the solution of chemicals, a pH between 6 and 11, between 7 and 11 in a particular embodiment, and between 7.5 and 10 in a further embodiment, can be established at the beginning of the process. The more likely alkaline pH of between 8 and 11, which is advantageous for the process according to the invention, also promotes the action of the quinone component. The process according to the invention is tolerant with regard to the pH; a small amount of chemicals is required for pH adjustment. This has an advantageous effect on the costs for chemicals.

Without further addition of acid or alkaline components, a pH of between 5.5 and 10, in general between 7.5 and 8.5, is established in the free-flowing solution of chemicals and the organic constituents dissolved therein, which were liquefied by the digestion, for example for softwood, at the end of the digestion. The dissolved organic constituents include in particular lignosulphonates.

The liquor ratio, i.e., the ratio of the amount of the oven-dry wood to the solution of chemicals, is adjusted to between 1:1.5 and 1:6. A liquor ratio of 1:3 to 1:5 is used in a particular embodiment In this range, good and easy mixing and impregnation of the material to be digested in ensured. For softwood, a liquor ratio of 1:4 is advantageous. For wood chips having a large surface area, the liquor ratio may also be substantially higher in order to permit rapid wetting and impregnation. At the same time, the concentration of the solution of chemicals can be kept high so that the amounts of liquid to be circulated are not too large.

The mixing or impregnation of the wood chips, in a particular embodiment, is effected at elevated temperatures. Heating of the wood chips and of the solution of chemicals to 110° C., to 120° C. in a particular embodiment, and to 130° C. in a further embodiment, leads to rapid and uniform digestion of the wood. For the mixing or impregnation of the wood chips, a period of up to 30 minutes, of up to 60 minutes in a particular embodiment, and of up to 90 minutes in a further embodiment, is advantageous. The duration which is optimum in each case depends, inter alia, on the amount of the chemicals and the liquor ratio and the method of digestion (liquid or vapor phase).

The digestion of the lignocellulosic material mixed or impregnated with the solution of chemicals, in a particular embodiment, is effected at temperatures between 120° C. and 190° C., and, in another embodiment, between 150° C. and 180° C. For most timbers, digestion temperatures between 155° C. and 170° C. are established. Higher or lower temperatures can be established but, in this temperature range, the energy consumption for the heating and the acceleration of the digestion are economically related to one another. Higher temperatures can moreover have an adverse effect on the strength, the yield and the whiteness of the fibrous materials. The pressure generated by the high temperatures can be readily absorbed by appropriate design of the digester. The duration of heating is dependent on the level of filling of the digester and, when little mass is introduced, i.e., at a low liquor ratio, is only a few minutes, generally up to 30 minutes, advantageously up to 10 minutes, particularly if heating is effected by means of steam. The duration of heating can be up to 90 minutes, up to 60 minutes in a particular embodiment, e.g., if digestion is effected in the liquid phase and the solution of chemicals is to be heated together with the chips.

The duration of digestion is chosen in particular as a function of the desired properties of the fibrous material. The duration of digestion can be shortened to 2 minutes, for example for the case of a vapor-phase digestion of a hardwood having a low lignin content. However, it may also be up to 180 minutes if, for example, the digestion temperature is low and the natural lignin content of the wood to be digested is high. Even if the initial pH of the digestion is in the neutral range, a long duration of digestion is required. The duration of digestion is up to 90 minutes in a particular embodiment, in particular in the case of softwood. In another embodiment, the duration of digestion is up to 60 minutes, advantageously up to 30 minutes. A duration of digestion of up to 60 minutes is suitable especially in the case of hardwoods. The use of a quinone component, in particular anthraquinone, permits a reduction in the duration of digestion to 25% of the time required without addition of anthraquinone. If the use of quinone components is dispensed with, the duration of digestion increases by more than one hour, for example, by 45 minutes to 180 minutes, for comparable digestion results.

According to an advantageous embodiment of the process according to the invention, the duration of digestion is established as a function of the chosen liquor ratio. The lower the liquor ratio, the shorter can the duration of the process be set.

The amount of chemicals to be used according to the invention for producing a fibrous material having a yield of at least 70% is up to 25% of sulphite for softwood and up to 18% of sulphite for hardwood, based in each case on the oven-dry wood material to be digested. The quality of the fibrous material produced gives the best results when the chemicals used comprise up to 15% of sulphite for softwood and hardwood. In a particular embodiment, the chemicals used comprise up to 20% of sulphite, and up to 15% of sulphite in a further embodiment, based on the oven-dry softwood used are added. For hardwoods, the use of chemicals tends to be lower, up to 12% of sulphite in a particular embodiment, and up to 10% of sulphite in a further embodiment. In order to achieve fibrous materials having the good strength properties according to the invention, the use of at least 7% of sulphite, based on the oven-dry wood material to be digested, is required.

Further investigations have shown that only a part of the chemicals, here in particular of the sulphite, is consumed during the partial digestion of the lignocellulosic raw material. The predominant part of the chemicals is discharged unconsumed, either before the digestion vapor-phase digestion) or after the digestion (digestion in the liquid phase). The consumption of chemicals is below the amounts used in the digestion solution.

The consumption of chemicals is recorded as the amount of chemicals (sulphite) which—based on the originally used amount of chemicals—is measured after removal or separation of the solution of chemicals and optionally the registration of the solution of chemicals, which is measured after the defibration or in combination with the registration of the solution of chemicals. The consumption of chemicals is dependent on the absolute amount of the chemicals used for the digestion, based on the oven-dry wood material to be digested. The greater the use of digestion chemicals, the lower is the direct conversion of chemicals. With the use of 25% of sulphite, based on oven-dry wood material, for example, only about 40% of the chemicals used are consumed. With the use of 16% of sulphite, based on oven-dry wood, however, about 45-50% of the chemicals used are consumed, as could be demonstrated in laboratory experiments.

The consumption of sulphite during the digestion is dependent on the lignin content of the starting raw material. The consumption of chemicals due to lignin degradation and other chemical reactions for producing one metric ton of fibrous material is

- up to 13% of sulphite for lignocellulosic raw material having a lignin content of more than 25%, based on oven-dry raw material (typically softwood, numerous hardwoods),
- up to 10% of sulphite for lignocellulosic raw material having a lignin content of 20% to 25%, based on oven-dry raw material (typically annual plants or hardwood having a low lignin content, such as poplar or beech)
- In the case of lignocellulosic raw material having a lignin content which, based on oven-dry raw material, is substantially below 20%, typically annual plants, such as grasses or bananas, the consumption of sulphite used initially for the digestion may also be below 10%, but at least 7%.

In order to ensure a standard result of the process and optionally to obtain particular, desired properties of fibrous material, only this relatively small amount of sulphite is consumed according to the invention. This 7% to 13% of sulphite which are actually consumed during the digestion constitute only a portion of the sulphite used altogether for the digestion. A solution of chemicals comprising up to 25% of sulphite, based on the lignocellulosic raw material to be digested, is nevertheless economical and expedient according to the invention, for positively influencing, for example, the reaction rate or for suppressing undesired secondary reactions. Only the amount of chemicals actually consumed in the digestion, in particular sulphite, is to be freshly added during the preparation of the solution of chemicals for the next digestion. The excess, unconsumed sulphite present in already used solution of chemicals is circulated according to a particular embodiment of the process according to the invention and is available again for the following digestion of lignocellulosic raw material.

From the above, it is evident that the digestion solution of the preceding digestion, which contains considerable amounts of unconsumed sulphite, is available for the processing or preparation of the solution of chemicals for the next digestion. In addition, however, the use of fresh or reprocessed chemicals is also required. According to a particular embodiment of the process according to the invention, it has proved expedient to branch off a part-stream from the already used solution of chemicals or digestion solution. This branched-off part-stream of the already used solution of chemicals is fed for reprocessing of the digestion chemicals, in particular of the sulphite. It is sufficient if only a part-stream of the solution of chemicals is fed for reprocessing after the digestion. A proportion of the chemicals, in particular the sulphite, which is consumed during the digestion can thus be recovered as fresh sulphite by reprocessing only a part-stream of the solution of chemicals. The other part-stream of the solution of chemicals or digestion solution, which is circulated without particular processing, directly from the circulation of spent solution of chemicals, and which contains unconsumed sulphite is used as a further substantial constituent of the digestion solution, as a rule with an above-mentioned proportion of freshly metered in or reprocessed sulphite, as described above. Unconsumed sulphite circulated without processing is used in a total amount of up to 75% of the sulphite required altogether for the digestion. Finally, fresh sulphite can additionally be metered in or prepared in the reprocessing of the chemicals or fresh sulphite is metered in directly during the preparation of the solution of chemicals.

According to an advantageous variant of the process according to the invention, up to 30% by weight, up to 50% by weight in a particular embodiment, and up to 75% by weight in a further embodiment, of sulphite from the recycling of the solution of chemicals already used for the digestion is used in the preparation of the solution of chemicals, while up to 70% by weight, up to 50% by weight in a particular embodiment, and up to 25% by weight in a further embodiment, of sulphite are used freshly or—designated as equivalent to fresh—from the reprocessing.

The use of these amounts of chemicals at the beginning of the digestion has an advantageous effect, since the fibrous materials obtained in this manner have properties not available to date, in particular good strength properties and good whitenesses. In particular, no digestion process has been available to date which produces fibrous materials having high strengths over a broad pH range from neutral to alkaline range. That the fibrous materials produced according to the invention can be beaten with a far lower energy demand to specified strengths than known fibrous materials has proved to be economically particularly attractive. Moreover, they develop the high strengths even at unusually low freenesses of 12°SR to 15°SR for softwood and of 20°SR for hardwood.

An excess of chemicals is present in the free-flowing liquid after the mixing and impregnation of the wood with the solution of chemicals or after digestion. This excess is subtracted before the digestion (1st alternative) or after digestion (2nd alternative). According to an advantageous further development of the process, the composition of the solution of chemicals which is removed is determined and then adjusted to a specified composition for further use for the production of fibers. The solution of chemicals which is removed before or after the digestion of the wood no longer has the initially established composition. At least a part of the chemicals used for the digestion has—as described above—penetrated into the material to be digested and/or has been consumed during the digestion. The unconsumed chemicals can readily be used again for the next digestion. However, it is proposed according to the invention initially to determine the composition of the removed solution of chemicals and then to replenish the consumed proportions of, for example, sulphite, alkaline component, quinone component or water or alcohol in order to prepare the specified composition again for the next digestion. This replenishment step is also referred to as fortification.

It is to be regarded as a considerable advantage of this measure that the solution of chemicals contains no substances at all or only very few substances which prove to be troublesome in further use of the fortified solution of chemicals for the next digestion only on removal before the digestion but also on removal after the digestion. The process according to the invention which is based on providing an oversupply of digestion chemicals during the impregnation can thus operate extremely economically in spite of the initially apparently uneconomical procedure involving the considerable use of chemicals, since the removal or the separation and the fortification of the solution of chemicals can be carried out simply and economically.

A further advantage of this measure is also that the solids content of the spent digestion solution increases after partial recycling. An increase from, for example, 9% to 22% solids content is possible after repeated recirculation. The calorific value of the spent digestion solution increases by up to 20%. In particular, the content of organic solids increases. The content of inorganic substances (sulphite, etc.) decreases from an absolute solids content of 56% after a first digestion to an absolute solids content of down to 44% after repeated recycling of the digestion solution.

The process according to the invention is controlled in a targeted manner so that only as little as possible of the lignocellulosic starting material used is degraded or dissolved. It is desirable to produce a fibrous material which has, for example for softwood, a lignin content of at least 15%, based on the oven-dry fiber material, a lignin content of at least 18% in a particular embodiment, and of 21% in a further embodiment, advantageously of at least 24%. For hardwood, it is desired to achieve a lignin content of at least 12%, based on the oven-dry fiber material, of at least 14% in a particular embodiment, and of at least 16% in a further embodiment, advantageously of at least 18%.

The yield of the process according to the invention is at least 70%, more than 75% in a particular embodiment, and advantageously more than 80%, based in each case on the lignocellulosic raw material used. This yield correlates with the abovementioned lignin content of the fibrous material. The original lignin content of a lignocellulosic raw material is specific for the type. In the present process, the loss of yield is a loss of lignin and readily hydrolysable hemicelluloses. In the case of unspecific digestion processes, the proportion of carbohydrates is substantially increased, for example because digestion chemicals also bring cellulose or hemicelluloses into solution in an essentially undesired manner.

A further, advantageous measure is to remove the still remaining solution of chemicals after the defibration and, if appropriate, beating of the lignocellulosic material and to reuse it. This reuse may comprise two aspects in a particular configuration. Firstly, the organic material, predominantly lignin, degraded or brought into solution during the partial digestion is further used. It is, for example, incinerated in order to obtain process energy. Alternatively, it is processed in order to be otherwise used. Secondly, the spent and unconsumed chemicals are reprocessed so that they can be used for a further, partial digestion of lignocellulosic material. This includes the processing of spent chemicals.

According to a variant of the process according to the invention, the solution of chemicals used is extremely efficiently utilized. After the defibration and, if appropriate, beating, the fibrous material is washed in order to displace the solution of chemicals as far as possible by water. The filtrate forming during this washing and displacement process contains considerable amounts of solution of chemicals and organic material. According to the invention, this filtrate is fed into the removed or separated solution of chemicals before the solution of chemicals is fortified and fed to the next digestion. The chemicals and organic constituents present in the filtrate do not disturb the digestion. If they make a contribution to the delignification during the next digestion, their content in the solution of chemicals is determined and is taken into account in the determination of the amount of chemicals which is required for this digestion. The further chemicals present in the filtrate are inert during the upcoming digestion. They do not cause problems. The organic constituents present in the filtrate are likewise inert. They are reused after the next digestion in the processing of the solution of chemicals, either to generate process energy or in another manner.

It is regarded as particularly advantageous that, by this management of the filtrate, less fresh water and fewer chemicals are used for the digestion. At the same time, a maximum of dissolved organic material is detected. This improved use of the organic material which has gone into solution also improves the cost-efficiency of the process according to the invention.

DETAILED DESCRIPTION OF THE INVENTION

Details of the process according to the invention and of the apparatus are explained in more detail below with reference to working examples.

The following experiments were evaluated according to the following specifications:

- The yield was calculated by weighing the raw material used and the chemical pulp obtained after the digestion, in each case dried at 105° C. to constant weight (absolutely dry).
- The lignin content was determined as Klason lignin according to TAPPT T 222 om-98. The acid-soluble lignin was determined according to TAPPI UM 250.
- The properties relating to paper technology were determined on test sheets which were produced according to Zellcheming data sheet V/8/76.
- The freeness was determined according to Zellcheming data sheet V/3/62.
- The bulk density was determined according to Zellcheming method V/ll/57.
- The breaking length was determined according to Zellcheming method V/12/57.
- The tear resistance was determined according to DIN 53 128 Elmendorf.
- The determination of tensile, tear and burst index was effected according to TAPPI 220 sp-96.
- The whiteness was determined by producing the test sheets according to Zellcheming data sheet V/19/63; measurement was effected according to SCAN C 11:75 using a Datacolor elrepho 450× photometer; the whiteness is stated in percent according to ISO standard 2470.
- The viscosity was determined according to data sheet IV/36/61 of the Association of the Pulp and Paper Chemists and Engineers (Zellcheming).
- All % data in this document are to be understood as meaning percent by weight, unless specifically stated otherwise.
- The statement "oven-dry" in this document relates to "oven-dry" material which was dried at 105° C. to constant weight.
- The chemicals for the digestion are stated in percent by weight as the respective chemical used, unless explained otherwise.

Example 1

Digestion in the Liquid Phase

A sodium sulphite digestion solution is added at a liquor ratio of wood:digestion solution 1:3 to spruce wood chips after steaming (30 minutes with saturated steam at 105° C.). The total chemicals used was 23.6%, calculated as sodium sulphite, based on oven-dry spruce wood chips.

The spruce wood chips impregnated with the solution of chemicals were heated to 170° C. over a period of 90 minutes and were digested at this maximum temperature over 180 minutes. The initial pH was in the range from pH 8.0 to 9.5.

Thereafter, the free-flowing liquid was removed by centrifuging, collected and analyzed in an arrangement for recycling unconsumed liquid and fortified and thus provided for the next digestion. Fortified means that the specified sulphite concentration is established again for the next digestion by addition of fresh or reprocessed sulphite. The chemical consumption in this first digestion is 82%.

The digested spruce chips were defibrated. Portions of the fibrous material thus produced were beaten for different times in order to determine the strength at different freenesses. The energy consumption for defibration of the partly digested spruce wood chips was less than 300 kWh/t of fibrous material.

The yield is 78.6%, based on oven-dry fibrous material. The breaking length was measured as 8 km at 14°SR, the tear index as 8.5 mN·m2/g. The whiteness was determined as 41% ISO after the digestion.

The solids content of the digestion solution was determined as 10.2% after the first digestion. The same digestion solution was fortified in each case again to the initial sulphite content described above, and further digestions were carried out under the same conditions in each case. After the fifth digestion, the solids content of the digestion solution was determined again as 20.4%.

The calorific value of the digestion solution after the first digestion was determined as 9.507 J/g. After the fifth digestion with in each case reused, fortified digestion solution, the calorific value was determined as 11.313 J/g.

After each of the five digestions under the conditions of Example 1, the consumption of sulphite was determined. It was on average 46%. For the fifth digestion, in which in each case the waste liquor of the preceding digestions was collected for the preparation of the digestion solution, the sulphite content was determined and the specified sulphite content was re-established by addition of fresh sulphite, 30% of the sulphite were added from unconsumed sulphite of the digestion solution from the preceding digestion and 70% of fresh sulphite.

Example 2

The fibrous material according to Example 2 was produced from spruce chips under the conditions of Example 1, with the following changes: in addition to the 23.6% of sulphite, 0.1% of anthraquinone, based on the amount of wood used, was added to the solution of chemicals. The duration of digestion was shortened to 45 minutes.

At 15°SR, a breaking length of 10.9 km and a tear resistance of 82 cN/100 g/m2 paper weight were determined for the spruce fibrous material according to Example 2. The whiteness was determined as 53.1% ISO and the yield was 76.7%.

The digestions according to Examples 3 and 4 explained below relate to vapor-phase digestions.

Example 3

Spruce wood chips are impregnated with 23.6% of sulphite at a liquor ratio of wood:solution of chemicals=1.5 at 120° C. in the vapor phase for 120 minutes. Chemicals used are sulphite and 0.1% of anthraquinone. At the beginning of the impregnation, a pH of 9.4 is established. After the impregnation, the solution of chemicals is removed.

The chips impregnated with the solution of chemicals are heated with steam in about 5 minutes to 170° C. This steam phase at 170° C. is maintained over 60 minutes. Thereafter, the steam is discharged and the digester is cooled to 100° C. in the course of 30 seconds, and ambient pressure is established. The chips are removed from the digester and defibrated. Portions of the spruce fibrous material thus produced are beaten and freeness and properties of the fibrous material are determined for the beaten portions.

At 14°SR, a breaking length of 9.3 km and 102 cN/100 g/m2 paper weight were measured. The whiteness was determined as 42.6% ISO and the yield was 78.9%.

For the following examples on hardwood digestions, Table 1 summarizes the experimental data.

Example 4, Example 5

A sodium sulphite digestion solution with addition of 0.1% of anthraquinone is added at a liquor ratio of wood:digestion solution 1:3 to birch chips after steaming (90 minutes with saturated steam at 105° C.). The total amount of chemicals used was 16.5%, calculated as sodium sulphite, based on oven-dry birch chips. The birch chips impregnated with the solution of chemicals are heated to 170° C. and digested over 60 minutes (Example 4) or over 80 minutes (Example 5) at this maximum temperature.

26.32% of the sulphite used (Example 4) or 32.52% of the sulphite used (Example 5) were consumed in the course of the digestion.

For Example 4, a yield of 85.34% and a whiteness of 68.81% ISO were determined after the digestion. At 20° SR, a breaking length of 8.4 km and a tear index of 6.9 mN·m2/g are measured for the birch. For Example 5, a yield of 83.99% and a whiteness of 69.82% ISO were determined after the digestion.

Example 6, Example 7, Example 8

A sodium sulphite digestion solution with addition of 0.1% of anthraquinone are added at a liquor ratio of wood:digestion solution 1:3 to beech chips after steaming (90 minutes with saturated steam at 105° C.). The total amount of chemicals used was 16.5%, calculated as sodium sulphite, based on oven-dry beech chips. The beech chips impregnated with the solution of chemicals were heated to 170° C. (Examples 6, 7) or to 160° C. (Example 8) and digested over 60 minutes (Example 6) or 48 minutes (Example 7) and over 55 minutes (Example 8).

The consumption of sulphite was 54.3% of the originally used sulphite in the case of Example 6, a consumption of 48.5% was determined in the case of Example 7 and the consumption of sulphite was 35.4%, based on the originally used sulphite, in the case of Example 8.

The yield was determined as 74.1% for Example 6, a yield of 75.2% was determined for Example 7 and the yield was 82.4% for Example 8. The whiteness was determined as 66.3% ISO for Example 6, as 62.9% ISO for Example 7 and as 69.9% ISO for Example 8.

For the beech fibrous material thus produced, a breaking length of 5.5 km was determined at 20°SR. The tear index was 4.8 mNm2/g.

Example 9, Example 10

A sodium sulphite digestion solution with addition of 0.1% of anthraquinone is added at a liquor ratio of wood:digestion solution 1:4 to poplar chips after steaming (90 minutes with saturated steam at 105° C.). The total amount of chemicals used was 19.7% in Example 9 and 16.5% in Example 10, calculated in each case as sodium sulphite, based on oven-dry poplar chips. The poplar chips impregnated with the solution of chemicals were heated to 170° C. and digested over 60 minutes.

The consumption of sulphite was 47.5% in the case of Example 9 and a consumption of 55.8% was determined in the case of Example 10, based in each case on the originally used sulphite.

The yield was determined as 76.5% for Example 9 and a yield of 77.2% was determined for Example 10. The whiteness was determined as 67.1% ISO for Example 9 and as 63.5% ISO for Example 10.

For the poplar fibrous material thus produced, a breaking length of 9.9 km was determined at 20°SR. The tear index was determined as 6.9 mN·m2/g.

Example 11, Example 12

A sodium sulphite digestion solution with addition of 0.1% of anthraquinone is added at a liquor ratio of wood:digestion solution 1:3 to poplar chips after steaming (90 minutes with saturated steam at 105° C.). The total amount of chemicals used was 16.5%, calculated as sodium sulphite, based on oven-dry poplar chips. The poplar chips impregnated with the solution of chemicals were heated to 170° C. (Example 11) or 160° C. (Example 12) and digested over 45 minutes (Example 11) or 90 minutes (Example 12)

The consumption of sulphite was 51.4% of the originally used sulphite in the case of Example 11. The sulphite consumption for Example 12 was not determined.

The yield was determined as 80.2% for Example 11 and a yield of 80.7% was determined for Example 12. The whiteness was determined as 64.1% ISO for Example 11 and as 69.3% ISO for Example 12.

The invention claimed is:

1. A process for producing fibrous material from lignocellulosic raw material, comprising:

preparing a solution of chemicals comprising sulphite (calculated as $Na_2SO_3$), wherein the sulphite is present in the solution of chemicals an amount that is less than 25% of sulphite, based on the oven-dry amount of the lignocellulosic raw material;

mixing the solution of chemicals with wood in a specified liquor ratio;

heating the solution of chemicals and the wood to a temperature above room temperature; and then either of the following:

removing a free-flowing solution of the chemicals and digesting the wood in a vapor phase;

digesting the wood in a liquid phase and separating a free-flowing solution of the chemicals and the wood, wherein:

the wood is softwood and the process produces a fibrous material comprising at least 15% of lignin, based on oven-dry fibrous material for softwood and a breaking length of between 8 km and 11 km, at a freeness of up to 15° SR; or the wood is hardwood and the process produces a fibrous material comprising at least 14% of lignin, based on oven-dry fibrous material for hardwood and a breaking length of between 5 km and 9.9 km, at a freeness of up to 20° SR, and wherein the digesting the wood is carried out at temperatures between 150° C. and 180° C., and wherein the fibrous material produced by the process has a yield of between 70% and about 85%; and the process further comprising beating the produced fibrous material to a maximum of 15° SR for softwood and to a maximum of 20° SR for hardwood.

2. A process according to claim 1, wherein:

the wood is softwood and the process produces a fibrous material comprising at least 17% of lignin, based on oven-dry fibrous material for softwood; or the wood is hardwood and the process produces a fibrous material comprising at least 16% of lignin, based on oven-dry fibrous material for hardwood.

3. A process according to claim 1, wherein:

the wood is softwood and the process produces a fibrous material comprising at least 19% of lignin, based on oven-dry fibrous material for softwood; or the wood is hardwood and the process produces a fibrous material comprising at least 18% of lignin, based on oven-dry fibrous material for hardwood.

4. A process according to claim 1, wherein:

the wood is softwood and the process produces a fibrous material comprising at least 21% of lignin, based on oven-dry fibrous material for softwood.

5. A process according to claim 1, wherein:

the wood is softwood and the breaking length is between 9 km and 11 km.

6. A process according to claim 1, wherein:

the wood is softwood and the breaking length is between 10 km and 11 km.

7. A process according to claim 1, wherein:

the wood is hardwood and the breaking length is between 6 km and 9.9 km.

8. A process according to claim 1, wherein:

the wood is hardwood and the breaking length is between 7 km and 9.9 km.

9. A process according to claim 1, wherein:

the preparing a solution of chemicals comprises using sulphites and sulphides, individually or as a mixture.

10. A process according to claim 4, wherein:

the preparing a solution of chemicals comprising at least one of sodium, potassium, magnesium, and/or ammonium sulphites.

11. A process according to claim 1, wherein:

the preparing a solution of chemicals comprises using a quinone component.

12. A process according to claim 1, wherein:

the process is carried out at a pH between 5.5 and 11.

13. A process according to claim 1, wherein:

the process is carried out at a pH between 5.5 and 10.

14. A process according to claim 1, wherein:

the process is carried out at a pH between 7.5 and 8.5.

15. A process according to claim 1, wherein:

a liquor ratio of wood:solution of chemicals of between 1:1.5 and 1:6 is established.

16. A process according to claim 1, wherein:

a liquor ratio of wood:solution of chemicals of between 1:3 and 1:5 is established.

17. A process according to claim 1, wherein:

the heating of the solution of chemicals and of the wood is effected up to 130° C.

18. A process according to claim 1, wherein:

the heating of the solution of chemicals and of the wood is effected up to 120° C.

19. A process according to claim 1, wherein:

the heating of the solution of chemicals and of the wood is effected up to 110° C.

20. A process according to claim 1, wherein:

the heating lasts up to 90 minutes.

21. A process according to claim 1, wherein:

the heating lasts up to 60 minutes.

22. A process according to claim 1, wherein:

the heating lasts up to 30 minutes.

23. A process according to claim 1, wherein:

the heating lasts up to 10 minutes.

24. A process according to claim 1, wherein:

the digesting the wood is carried out at temperatures between 160° C. and 170° C.

25. A process according to claim 1, wherein:

the digesting the wood lasts for up to 180 minutes.

26. A process according to claim 1, wherein:

the digesting the wood lasts for up to 90 minutes.

27. A process according to claim 1, wherein:

the digesting the wood lasts for up to 60 minutes.

28. A process according to claim 1, wherein:

the digesting the wood lasts for up to 30 minutes.

29. A process according to claim 1, wherein:

the digesting the wood lasts for up to 2 minutes.

30. A process according to claim 25, wherein:

the duration of the digesting is a function of the liquor ratio.

31. A process according to claim 1, wherein:

up to 13% of sulphite, based on oven-dry lignocellulosic raw material are consumed for the digestion of lignocellulosic raw material having a lignin content of more than 25%, based on oven-dry raw material;

up to 10% of sulphite are consumed for the digestion of lignocellulosic raw material having a lignin content of 20% to 25%, based on oven-dry raw material; and less than 10% of sulphite is consumed, but at least 7% of sulphite are used, for the digestion of lignocellulosic raw material having a lignin content of up to 20%, based on oven-dry raw material.

32. A process according to claim 1, wherein:

the wood is softwood and the digesting of the wood uses up to 25% of sulphite.

33. A process according to claim 1, wherein:

the wood is softwood and the digesting of the wood uses up to 20% of sulphite.

34. A process according to claim 1, wherein:

the wood is softwood and the digesting of the wood uses up to 15% of sulphite.

35. A process according to claim 1, wherein:

the wood is softwood and the digesting of the wood uses at least 7% sulphite.

36. A process according to claim 1, wherein:

the wood is hardwood and the digesting of the wood uses up to 15% of sulphite.

37. A process according to claim 1, wherein:

the wood is hardwood and the digesting of the wood uses up to 12% of sulphite.

38. A process according to claim 1, wherein:

the wood is hardwood and the digesting of the wood uses up to 10% of sulphite.

39. A process according to claim 1, wherein:

the wood is hardwood and the digesting of the wood uses up to 7% of sulphite.

40. A process according to claim 1, wherein:

the preparing a solution of chemicals comprises using up to 75% by weight of the sulphite from recycling of the solution of chemicals already used for the digesting, and at least 25% by weight of the sulphite are freshly added.

41. A process according to claim 1, wherein:

the preparing a solution of chemicals comprises using up to 50% by weight of the sulphite from recycling of the solution of chemicals already used for the digesting, and at least 50% by weight of the sulphite are freshly added.

42. A process according to claim 40, wherein:

the sulphite freshly added comprises the following amounts in preparing the solution of chemicals:

up to 13% in the case of lignocellulosic raw material having a lignin content of more than 25%, based on oven-dry raw material;

up to 10% in the case of lignocellulosic raw material having a lignin content of 20% to 25%, based on oven-dry raw material;

less than 10% in the case of lignocellulosic raw material having a lignin content of less than 20%, calculated in each case as $Na_2SO_3$, based on oven-dry lignocellulosic raw material.

43. A process according to claim 1, further comprising:

determining the composition of the removed or separated free-flowing solution of chemicals; and adjusting the composition to a specified composition for further use in the process for producing fibrous material.

44. A process according to claim 1, further comprising:

removing and further using the solution of chemicals, released after defibration.

45. A process according to claim 1, further comprising:

removing and further using the solution of chemicals, released after defibration and beating of the digested lignocellulosic material.

46. A process according to claim 1, wherein:

after said digesting the wood a digestion solution is created;

said process further comprising circulating the digestion solution to increase a solids content of said circulated digestion solution by up to 5%.

47. A process according to claim 1, wherein:

after said digesting the wood a digestion solution is created;

said process further comprising circulating the digestion solution to increase a solids content of said circulated digestion solution by up to 10%.

48. A process according to claim 1, wherein:

after said digesting the wood a digestion solution is created;

said process further comprising circulating the digestion solution to increase a solids content of said circulated digestion solution by up to 15%.

49. A process according to claim 48, wherein:

the circulated digestion solution has a calorific value up to 1.5 MJ/kg higher than a freshly prepared digestion solution.

50. A process for producing fibrous material from lignocellulosic raw material, comprising:

preparing a solution of chemicals comprising between at least 7% and less than 25% of sulphite (calculated as $Na_2SO_3$), based on the oven-dry amount of the lignocellulosic raw material;

mixing the solution of chemicals with wood in a specified liquor ratio;

heating the solution of chemicals and the wood to a temperature above room temperature; and then either of the following:

removing a free-flowing solution of the chemicals and digesting the wood in a vapor phase;

digesting the wood in a liquid phase and separating a free-flowing solution of the chemicals and the wood, wherein:

the wood is softwood and the process produces a fibrous material comprising at least 15% of lignin, based on oven-dry fibrous material for softwood and a breaking length of between 8 km and 11 km at a freeness of up to 15° SR; or the wood is hardwood and the process produces a fibrous material comprising at least 14% of lignin, based on oven-dry fibrous material for hardwood and a breaking length of between 5 km and 9.9 km at a freeness of up to 20° SR, wherein the digesting the wood is carried out at temperatures between 150° C. and 180° C., and wherein the fibrous material produced by the process has a yield of between 70% and about 85%; and the process further comprising beating the produced fibrous material to a maximum of 15° SR for softwood and to a maximum of 20° SR for hardwood.

51. A process for producing fibrous material from lignocellulosic raw material, comprising:

preparing a solution of chemicals comprising between at least 7% and up to 15% of sulphite (calculated as $Na_2SO_3$), based on the oven-dry amount of the lignocellulosic raw material;

mixing the solution of chemicals with wood in a specified liquor ratio;

heating the solution of chemicals and the wood to a temperature above room temperature; and then either of the following:

removing a free-flowing solution of the chemicals and digesting the wood in a vapor phase;

digesting the wood in a liquid phase and separating a free-flowing solution of the chemicals and the wood, wherein:

the wood is softwood and the process produces a fibrous material comprising at least 15% of lignin, based on oven-dry fibrous material for softwood and a breaking length of between 8 km and 11 km at a freeness of up to 15° SR; or the wood is hardwood and the process produces a fibrous material comprising at least 14% of lignin, based on oven-dry fibrous material for hardwood and a breaking length of between 5 km and 9.9 km at a freeness of up to 20° SR, wherein the digesting the wood is carried out at temperatures between 150° C. and 180° C., and wherein the fibrous material produced by the process has a yield of between 70% and about 85%; and the process further comprising beating the produced fibrous material to a maximum of 15° SR for softwood and to a maximum of 20° SR for hardwood.

* * * * *